United States Patent [19]

Hyman et al.

[11] Patent Number: 4,974,850

[45] Date of Patent: Dec. 4, 1990

[54] VIBRATION TRIGGERED GAME DEVICE

[76] Inventors: Greg Hyman, 377 Cross Pond Rd., Rt. 2, Pound Ridge, N.Y. 10576; Victor G. Reiling, P.O. Box 180, West Cornwall, Conn. 06796

[21] Appl. No.: 369,192

[22] Filed: Jun. 21, 1989

[51] Int. Cl.[5] ..... A63F 9/00

[52] U.S. Cl. ..... 273/1 GG; 273/1 GF; 273/1 GG; 273/237; 340/683

[58] Field of Search ..... 273/1 GC, 1 GF, 1 GG, 273/237; 340/429, 566, 683

[56] References Cited

U.S. PATENT DOCUMENTS

| | | | |
|---|---|---|---|
| 2,581,644 | 1/1952 | Frick | 273/1 GC |
| 3,158,370 | 11/1964 | Pearson, Jr. | 273/1 GC |
| 3,565,426 | 2/1971 | Glass et al. | 273/1 GC |
| 3,572,704 | 3/1971 | Glass et al. | 273/1 GC |
| 3,805,030 | 4/1974 | Wichinsky et al. | 340/683 X |
| 4,170,769 | 10/1979 | Morris et al. | 340/566 X |
| 4,282,518 | 8/1981 | Bonner | 340/566 |
| 4,381,504 | 4/1983 | Bitko | 340/683 X |
| 4,470,040 | 9/1984 | Kaminishi | 340/683 X |
| 4,479,114 | 10/1984 | Yamamoto | 340/566 |
| 4,636,775 | 1/1987 | Burgess et al. | 340/566 |
| 4,763,898 | 8/1988 | Hemmann | 273/1 GF |
| 4,874,166 | 10/1989 | Kuna | 273/1 GC |

FOREIGN PATENT DOCUMENTS

| | | | |
|---|---|---|---|
| 2070943 | 9/1981 | United Kingdom | 273/1 GC |

*Primary Examiner*—Paul E. Shapiro
*Attorney, Agent, or Firm*—Darby & Darby

[57] ABSTRACT

Vibration triggered game device having a housing with a vibration sensitive reference base to generate vibrations in response to a manually applied vibratory stimulus during game play, and a circuit to sense the level of those vibrations relative to a preselective, e.g. adjustable, threshold value, and including an indicator, e.g. an audible signal emitter, triggered when that level exceeds the threshold value, to indicate the achieving of an event in the game. The circuit may include a piezo transducer to detect the vibrations and to emit the signal. The housing may be a game board provided with play elements depositable on, movable along, and/or removable from, the reference base, or the housing may be an object graspable during play, with all such manual actions being effectable at a vibration level above or below the threshold value depending upon player skill and dexterity.

6 Claims, 4 Drawing Sheets

VIBRATION TRIGGERED GAME DEVICE

FIELD AND BACKGROUND OF THE INVENTION

The present invention relates to a vibration triggered game device, and more particularly to such a device which is sensitive to vibrations generated by a manually applied vibratory stimulus during play of the game, and which triggers a signal when those vibrations exceed a preset threshold value to designate the achieving of an event in the game.

U.S. Pat. No. 2,636,737 to Levay and U.S. Pat. No. 3,158,870 to Pearson, Jr. disclose game devices testing manual coordination of the player in manipulating player elements to avoid closing a switch energizing a circuit that signals the end of a play.

U.S. Pat. No. 4,394,017 to Maloy shows a game device in which at a given stage a player must close a switch energizing a vibrator to vibrate a platform containing play elements, some of which may be physically retained on the platform and others merely loosely deposited thereon, depending on the stage of play, whereupon any loosely deposited play elements may topple, thereby influencing the score of the game.

U.S. Pat. No. 1,977,116 to Conwill discloses a hand held cylindrical game device having a series of aligned openings at different vertical levels therein, through which a ball fed at the top will pass if the manual coordination of the player is sufficient to balance the device precisely upright, as otherwise the ball will be side tracked at a given level.

U.S. Pat. No. 3,960,376 to Berlin shows a like hand held vertical game device having a series of lamps successively energized and deenergized in continuous time delayed sequence by a trigger circuit, normally closed by a gravity actuated, e.g. mercury, switch if the manual coordination of the player is sufficient to balance the device precisely upright, as otherwise the switch will open and extinguish the lamps.

It would be desirable to provide a game device testing the manual skill and dexterity of the player in relation to a preset, especially adjustable, threshold standard, regarding a wide variety of different type games, and which may be used in any spatial orientation and without the need for electrical switches to indicate the achievement of an event in the game.

SUMMARY OF THE INVENTION

It is among the objects of this invention to provide a vibration triggered game device which generates vibrations in response to a manually applied vibratory stimulus during play of the game, and which triggers the achieving of an event in the game when the vibration level exceeds a preselective, especially adjustable, threshold value, such as where the device is a vibration sensing game board having depositable, movable and/or removable play elements, or is a vibration sensing graspable object, with play being effectable at a vibration level above or below the threshold value depending upon player skill and dexterity.

It is among the additional objects of this invention to provide such a game device which is adjustable in vibration sensing and triggering value, which consumes minimum energizing power during play, which can be fabricated from conventional materials and circuit components in simple and inexpensive manner, and which is robust and serviceable in use.

According to this invention, a vibration triggered game device is provided which comprises a housing having a vibration sensitive reference base arranged for generating vibrations in response to a manually applied vibratory stimulus thereto during play of the game, and a vibration responsive, energizable circuit arranged for sensing the level of vibrations generated by the reference base relative to a preselective threshold value, and including indicator means, triggered when that level exceeds the threshold value, to indicate the achieving of an event in the game.

Desirably, the circuit includes control means for adjusting the threshold value, and a piezo transducer arranged for detecting the level of generated vibrations and serving as indicator means for emitting an audible signal when that level exceeds the threshold value.

In particular, the circuit may include a piezo transducer arranged adjacent the reference base and constituting operatively both a microphone for detecting the generated vibration level and providing an input signal, and a speaker for emitting an audible alarm signal, in conjunction with a sensitivity control for adjusting the threshold value, an audio amplifier for amplifying the vibration level detecting microphone input signal when it exceeds the threshold value, a rectifier and voltage doubler for producing a resultant signal, an electronic switch responsive to the resultant signal, a timer responsive to the switch for providing an output signal of timed duration, and an oscillator coupled to the piezo transducer for emitting an audible alarm signal therethrough as a speaker in dependence upon the output signal from the timer.

According to one aspect of the invention, the reference base has a depository area, and one or more manually depositable or removable individual play elements are provided which are capable of being manually deposited in selective disposition on, or manually removed from, the depository area at a generated vibration level above or below the threshold value in dependence upon player skill and dexterity.

In one form, the housing may be a game board, and the depository area maY contain separate designated zones on which correspondingly designated play elements may be so manually deposited, or from which play elements thereon may be so manually removed. In a given case, the zones may be provided with local mounting formations of at least two individually different shapes, and the play elements may include at least two individually different counterpart mating shape play elements for conforming removable mounting disposition on the corresponding local formations at a generated vibration level above or below the threshold value in dependence upon player skill and dexterity.

In another form, the housing may be a game board, and the deposition area may be arranged to permit a play element to be moved manually thereon while remaining in contact therewith at a generated vibration level above or below the threshold value in dependence upon player skill and dexterity.

According to another aspect of the invention, the housing is a manually holdable object which is grasped manuallY during play of the game, and the reference base is arranged such that the object is capable of being grasped in any spatial orientation at a generated vibration level above or below the threshold value in dependence upon player skill and dexterity.

BRIEF DESCRIPTION OF THE DRAWINGS

Other objects of the invention will become apparent from the within specification and accompanying drawings, in which.

DESCRIPTION OF THE PREFERRED EMBODIMENTS

Figure 1:
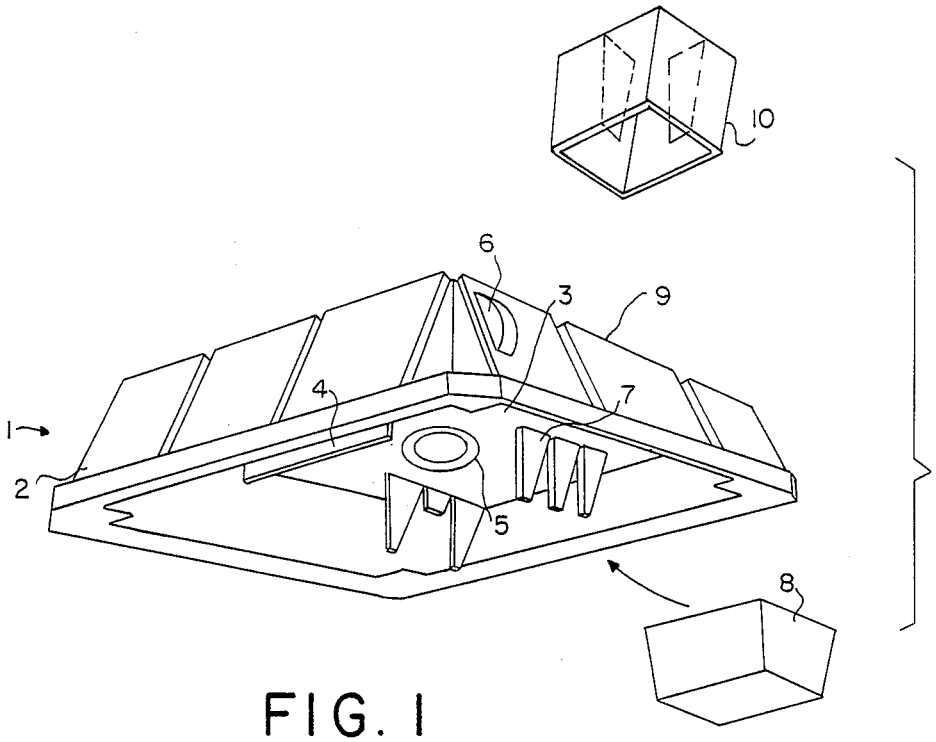
FIG. 1 is a schematic exploded perspective view of a game device according to the invention in the form of a game board provided with plaY elements.
Figure 2:
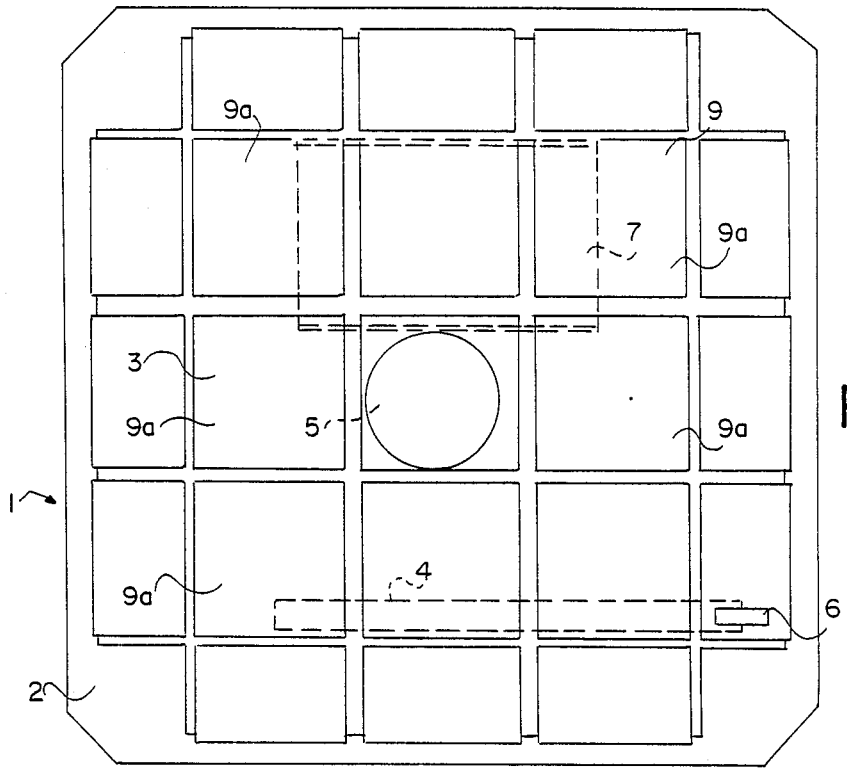
FIGS. 2 and 3 are top and side views respectively of the device of FIG. 1, showing pertinent parts.
Figure 3:
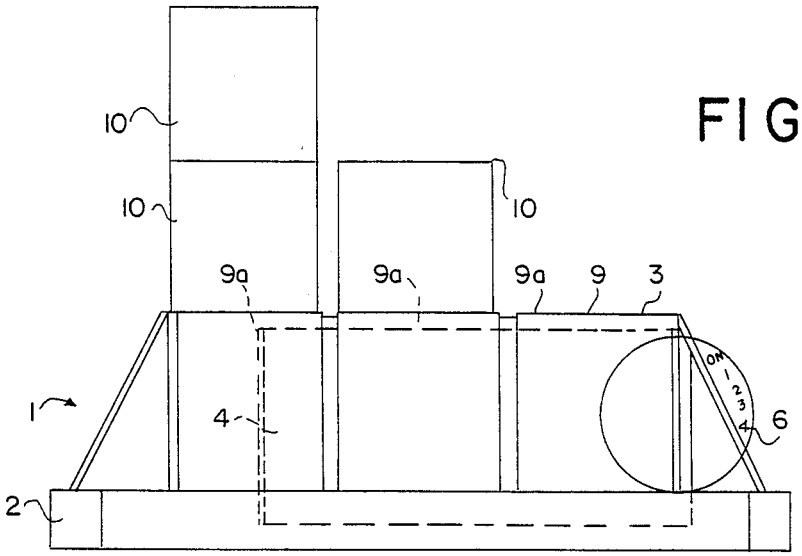

Referring to the drawings, and initially to Figs 1–3, a vibration triggered game device 1 is shown, including a housing 2 having a vibration sensitive reference base S, e.g. as a top wall or exterior surface of housing 2 to serve as a game board, and arranged to generate vibrations in response to a manually applied vibratory stimulus thereto during game play.

Housing 2 also has a vibration responsive, energizable circuit 4 (FIG. 4), e.g. on a printed circuit board mounted on an interior side wall of housing 2, to which a piezo transducer 5 is connected. Piezo transducer 5 is arranged on the underside of reference base 3 to sense the level of vibrations generated by reference base relative to a preselective threshold value, as adjusted by the partially exposed threshold control e.g. provided on the printed circuit board as a thumbwheel which also serves as an on-off switch for circuit 4.

Circuit 4 is powered by a battery of dry cells, e.g. four 1.5 volt cells, mounted in battery holder 7 at the underside of reference base 3 under removable battery cover 8.

Figure 4:
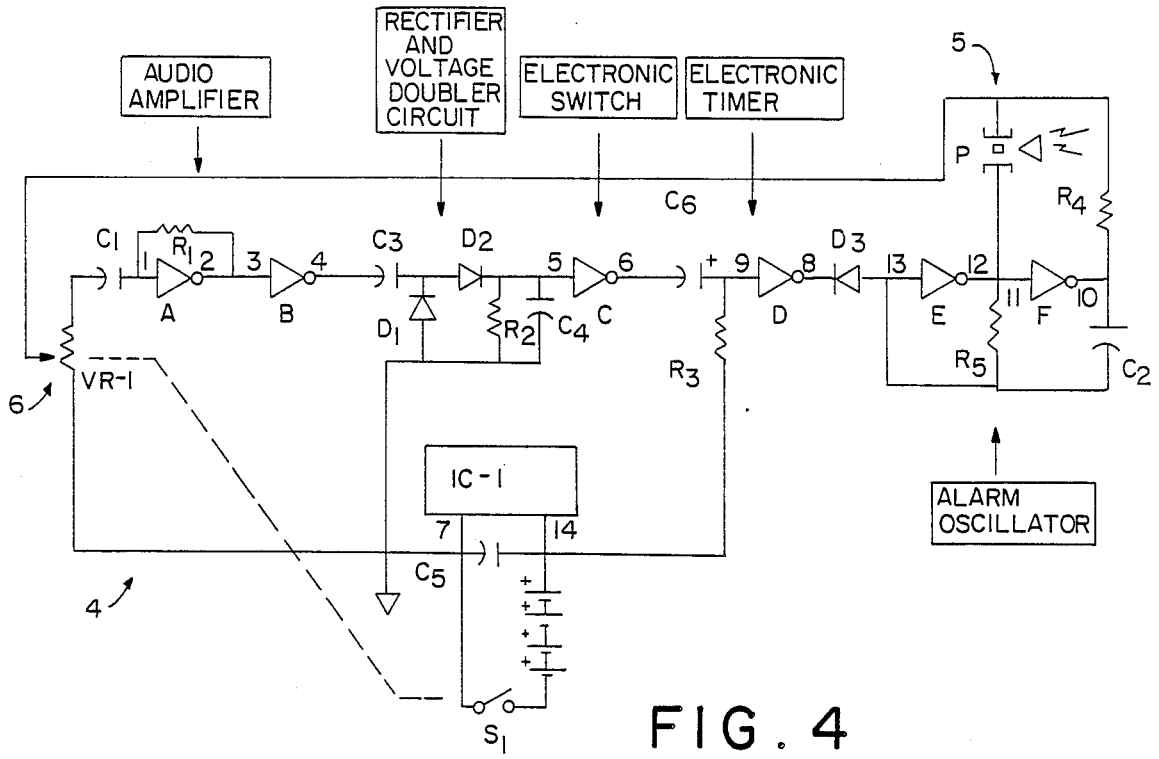
FIG. 4 is a schematic diagram of the circuit used in the device of FIG. 1.

As shown in FIG. 4, piezo transducer 5 is not only arranged adjacent reference base 3 to detect the level of its generated vibrations but advantageously also serves as an indicator means in circuit 4, triggered when that level exceeds the threshold value, to emit an audible signal indicating the achieving of an event in the game such as the loss of a turn or other penalty. The function of circuit 4 is to detect relatively small amounts of vibration and cause an audible signal or alarm tone to sound for a specific time period when the preset threshold value of sensitivity to vibration is exceeded by player applied vibratory disturbance of reference base 3 as electronically sensitized by the system of circuit 4, piezo transducer 6 and threshold control 6.

Specifically, circuit 4 is an integrated circuit containing six inverter modules A to F, configured to perform in association with piezo transducer 5, designated P, which constitutes operatively both a microphone to detect the generated vibration level and provide an input signal, and a speaker to emit an audible alarm signal, and which is present in circuit 4 in conjunction with threshold control 6, designated sensitivity control VR-1, which adjusts the threshold value of the microphone input signal as output to set in turn the alarm sensitivity threshold.

Specifically, capacitor C1 couples the signal from piezo transducer 5 (P) and threshold control 6 (VR-1) to an audio amplifier consisting of the integrated circuit, designated IC-1 (e.g. a commercially available component such as one identified as National CD-4069 BCN). plus modules A and B. and resistor Ri, to amplify the vibration level detecting microphone signal when it exceeds the threshold value. The resulting amplified AC signal, generated when piezo transducer 5 senses vibration, is coupled by capacitor C3 to a rectifier and voltage doubler circuit made up of diodes D1 and D2, resistor R2 and capacitor C4.

The resultant DC voltage produced by the voltage doubler causes the electronic switch responsive thereto, i.e. made up of integrated circuit IC-1 and module C, to start the electronic timer responsive to the switch, and consisting of capacitor C6, resistor R3, integrated circuit IC-1 and module D, to provide an output signal of timed duration. When started, the timer, via diode D8, enables the alarm oscillator, consisting of integrated circuit IC-1, modules E and F, capacitor C2 and resistors R4 and R5. The enabled oscillator is coupled to piezo transducer 5 to emit an audible alarm signal therethrough as a speaker in dependence upon the timer output signal.

Once enabled, the alarm tone will sound for about 2 to 3 seconds until the timer turns it off. When the alarm is sounding, however, its output is coupled to piezo transducer 5 which functions as a speaker for the duration of the alarm. When the alarm stops sounding, the timer automatically resets, and the circuit is ready for the next activation.

Circuit 4 is favorably powered by four "AA" 1.5 V dry cells or batteries via on-off switch S1 in conjunction with capacitor C5 which serves as a power supply filter. By conveniently providing threshold control 6 as a conventional, e.g. linear taper, sensitivity thumbwheel containing on-off switch S1, a graduating series of numerical "levels of skill" threshold values may be provided on the wheel periphery (cf. FIG. 3) as selective manual skill and dexterity game standards.

In regard to one form of use of device 1 as a game board, reference base 3 may be provided with a depository area 9, and one or more manually depositable or removable individual play elements 10 may be associated therewith which are capable of being manually deposited in selective disposition on, or manually removed from, depository area 9 at a level of generated vibrations above or below the threshold value depending on the skill and dexterity of the player. For this purpose, depository area 9 may contain a plurality of separate designated zones 9*a* on which correspondingly designated play elements 10 may be so manually deposited (FIG. 3), or from which play elements thereon may be so manually removed.

Where zones 9*a* are disposed in several vertically and horizontally aligned or crisscross rows (FIG. 2), for example, a game of electronic "tic tac toe" may be played in which the play elements 10 are individually deposited during play, or an analogous game in which already deposited play elements 10 are individually removed during play.

Alternatively, deposition area 9 may be arranged as a generally smooth or continuous slide surface type game board (FIGS. 2–3), to permit a play element 10 to be moved manually thereon while remaining in contact therewith at a generated vibration level above or below the threshold value in dependence upon player skill and dexterity. This form may be used for an electronic crossword puzzle, chess, checkers or any other analogous type game in which during play the play elements are moved or slid along deposition area 9, e.g. from one zone 9a to another. A further use of such deposition area 9 is to play a game of "pick-up sticks" with play elements of appropriate "stick" shape.

Figure 5:
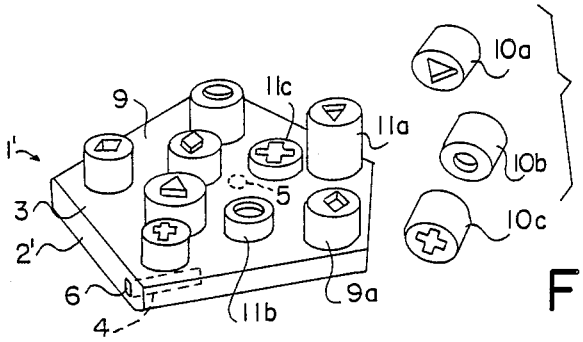
FIG. 5 is a view of a device similar to that of FIG. 1 but of a modified form.

Alternatively, as shown in the embodiment of FIG. 5, in which the parts are the same as those in the embodiment of FIGS. 1–3 except for modified parts otherwise designated, zones 9a on housing 2' of device 1' may be provided with local, e.g. raised, mounting formations 11a, 11b, 11c, etc. of a plurality of individually different shapes, e.g. cruciform, square, triangular, cylindrical, bar, etc. shapes, with the play elements including a corresponding plurality of individually different counterpart mating shape play elements 10a, 10b, 10c, etc., e.g. such that the formations and play elements have mating plug and socket. i.e. male and female, profiles.

In this way the mating play elements are such as to permit conforming removable mounting disposition thereof on the local formations at a generated vibration level above or below the threshold value depending on player skill and dexterity. Thus, the game may be played in such manner that the disposition of the play elements is restricted to predesignated local formations by reason of the specific shapes, and plug and socket profiles, of the interacting parts involved, with the players taking turns in depositing or removing the play elements, or in conjunction with a game such as "Simon Says" (. . . deposit a cruciform player element on its counterpart game board formation.), or one in which a die is thrown, etc.

Figure 6:
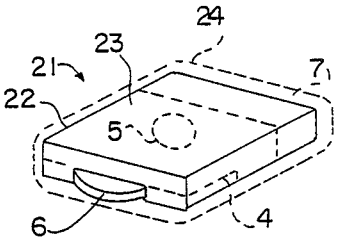
FIG. 6 is a schematic view of another device of the invention in the form of a manually holdable object.

In the embodiment shown in FIG. 6, the device 21 has the same parts as the other embodiments, including circuit 4, piezo transducer 5 and threshold control 6, but here the housing 22 forms a manually holdable object which is grasped manually during play of the game, and its reference base 23 is arranged such that the object is capable of being grasped in any spatial orientation at a generated vibration level above or below the threshold value depending on player skill and dexterity. This form of the device may be used where the object is to be passed from one hand to another or from one player to another, as in passing a "dollar bill" or "passing the buck".

By providing a cover 24 (shown in phantom) on housing 22, and optionally soft padding material therebetween, device 21 maY be used to play "pick pocket" or an analogous game in which the object is to be removed from a pocket or the like.

In all such cases, the intent is to achieve manual manipulation of the housing and/or play elements without reaching a level of vibrations, e.g. by rough or unsteady touching of the device, or dropping of a play element thereon, or rough or unsteady depositing or removal of a play element, etc., that would trigger a response from circuit 4, resulting in the setting off of an alarm indicating an event in the game, e.g. loss of a turn or other game play penalty.

Of course, in those devices contemplating the associated use of play elements, these may be of any suitable size and shape, depending on the game, such as blocks or sticks that may be stacked on one another and/or on the depository area, and the depository area may be of conforming game board shape and profile, as exemplified by the embodiments of FIGS. 1–3 and 5. On the other hand, where the device is to be used as an object, without any associated play elements, its size and shape will depend on the purpose of the game, such as a wallet sized and shaped object, as exemplified in the embodiment of FIG. 6.

The device, and particularly the housing and its reference base, as well as the player elements where present (FIGS. 1–3 and 5), may be made of suitable stiff or rigid, vibration transmitting plastic, and the optional device cover (FIG. 6) may be made of suitable pliable plastic, in conventional manner. The circuit (board) components, including the associated piezo transducer and threshold control, plus the battery holder, all of which are commercially available individual components, may be mounted on the given housing in accordance with known technique.

The reference base of course is constructed and arranged to perform as a kind of sounding board for the adjacently positioned piezo transducer, so as to generate the stated vibrations for efficient sensing and detection by the piezo transducer to trigger the alarm indicating signal when the vibration level exceeds the selected threshold value.

It will be seen that although the sensitivity of the device may be selected with particular precision to determine the level of skill and dexterity of the player, the construction is such that the device is readily adjustable in vibration sensing and triggering value, consumes minimum energizing power during play, can be fabricated from conventional materials and circuitry components in simple and comparatively inexpensive manner, and is robust and serviceable in use.

Furthermore, the construction is such that play of the game is not dependent upon the closing of any switch in an electrical circuit, in a non-adjustable all-or-none manner, or under conditions limiting usage of the device to a specific spatial orientation, as with certain conventional game devices as earlier described.

Instead, the device of the invention obviates such switches and may be played in any spatial orientation, i.e. vertical, horizontal, angular, upside down, etc., as it uses the vibration sensitivity of the reference base as an electronically sensitized base in conjunction with the adjustable vibration sensing and alarm triggering circuit to determine success or failure of play, in direct dependence upon the skill and dexterity of the player in generating vibrations at a level below (for success) or above (for failure) the preset threshold value of the circuit during touch of the device directly via the hand or indirectly via a play element being deposited (or dropped) on, moved along, or removed from, the device.

Thus, the device construction of the invention lends itself to playing a wide variety of well known games.

It will be appreciated that the foregoing specification and accompanying drawings are set forth by way of illustration and not limitation of the present invention, and that various modifications and changes may be made therein without departing from the spirit and scope of the present invention which is to be limited solely by the scope of the appended claims.

What is claimed is:

1. A vibration triggered game device comprising:

a housing having a vibration sensitive reference base arranged for generating vibrations in response to a manually applied vibratory stimulus thereto during play of the game, and a vibration responsive, energizable circuit arranged for sensing the level of vibrations generated by the reference base relative to a preselective threshold value, and including indicator means, triggered when that level exceeds the threshold value, to indicate the achieving of an event in the game, wherein the circuit includes a piezo transducer arranged for detecting the level of generated vibrations and serving as indicator means for emitting an audible signal when that level exceeds the threshold value, said piezo transducer being arranged adjacent the reference base and constituting operatively both a microphone for detecting the level of the generated vibrations and providing an input signal, and a speaker for emitting an audible alarm signal, in conjunction with a sensitivity control for adjusting the threshold value, an audio amplifier for amplifying the vibration level detecting microphone input signal when it exceeds the threshold value, a rectifier and voltage doubler for producing a resultant signal, an electronic switch responsive to the resultant signal, a timer responsive to the switch for providing an output signal of timed duration, and an oscillator coupled to the piezo transducer for emitting an audible alarm signal therethrough as a speaker in dependence upon the output signal from the timer.

2. Device of claim 1 wherein the reference base has a depository area, and one or more manually depositable or removable individual play elements are provided which are capable of being manually deposited in selective disposition on, or manually removed from, the depository area at a level of generated vibrations above or below the threshold value in dependence upon the skill and dexterity of the player.

3. Device of claim 2 wherein the housing is a game board, and the depository area contains separate designated zones on which correspondingly designated play elements may be so manually deposited, or from which play elements thereon may be so manually removed.

4. Device of claim 3 wherein the zones are provided with local mounting formations of at least two individually different shapes, and the play elements include at least two individually different counterpart mating shape play elements for conforming removable mounting disposition on the corresponding local formations at a level of generated vibrations above or below the threshold value in dependence upon the skill and dexterity of the player.

5. Device of claim 2 wherein the housing is a game board, and the deposition area is arranged to permit a play element to be moved manually thereon while remaining in contact therewith at a level of generated vibrations above or below the threshold value in dependence upon the skill and dexterity of the player.

6. Device of claim 1 wherein the housing is a manually holdable object which is grasped manually during play of the game, and the reference base is arranged such that the object is capable of being grasped in any spatial orientation at a level of generated vibrations above or below the threshold value in dependence upon the skill and dexterity of the player.

* * * * *